US008971785B2

(12) United States Patent
Nakajima

(10) Patent No.: US 8,971,785 B2
(45) Date of Patent: Mar. 3, 2015

(54) CLEANING UNIT AND IMAGE FORMING DEVICE HAVING THE SAME

(71) Applicant: Murata Machinery, Ltd., Kyoto-shi, Kyoto (JP)

(72) Inventor: Takehiro Nakajima, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 14/021,932

(22) Filed: Sep. 9, 2013

(65) Prior Publication Data

US 2014/0093296 A1 Apr. 3, 2014

(30) Foreign Application Priority Data

Sep. 28, 2012 (JP) ..... 2012-217384

(51) Int. Cl.
*G03G 21/00* (2006.01)
*G03G 21/10* (2006.01)
*G03G 21/12* (2006.01)

(52) U.S. Cl.
CPC ..... *G03G 21/105* (2013.01); *G03G 21/10* (2013.01); *G03G 21/12* (2013.01)
USPC ..... 399/358; 399/123; 198/659

(58) Field of Classification Search
CPC ..... G03G 1/10; G03G 21/105
USPC ..... 399/123, 358; 198/659
See application file for complete search history.

(56) References Cited

U.S. PATENT DOCUMENTS

| | | | | |
|---|---|---|---|---|
| 5,233,399 | A * | 8/1993 | Shiino et al. | 399/353 |
| 2010/0189471 | A1* | 7/2010 | Yuge | 399/264 |
| 2010/0232852 | A1 | 9/2010 | Noso | 399/358 |

FOREIGN PATENT DOCUMENTS

| | | |
|---|---|---|
| JP | 2000-098747 | 4/2000 |
| JP | 2008-233240 | 10/2008 |

* cited by examiner

*Primary Examiner* — Benjamin Schmitt
(74) *Attorney, Agent, or Firm* — DLA Piper LLP (US)

(57) ABSTRACT

A cleaning unit includes a cleaning member, a storage case, and a transport member. The cleaning member collects waste toner on a surface of the photoconductive drum. The storage case successively stores the waste toner collected by the cleaning member through an inlet. The transport member is provided in the storage case, and rotates to transport the waste toner in the storage case in a rotary axis direction. The transport member rotates with a central portion in the rotary axis direction protruding toward the inlet further than both side portions.

7 Claims, 4 Drawing Sheets

CLEANING UNIT AND IMAGE FORMING DEVICE HAVING THE SAME

CROSS-REFERENCE TO RELATED APPLICATIONS

This application claims priority under 35 U.S.C. 119 to Japanese Patent Application No. 2012-217384, filed on Sep. 28, 2012, which application is hereby incorporated by reference in its entirety.

BACKGROUND OF THE INVENTION

1. Field of the Invention

The present invention relates to a cleaning unit for removing toner and paper dusts that remain on the surface of the photoconductive drum and an image forming device having the cleaning unit.

2. Description of the Related Art

In electrophotography-type image forming devices including copying machines and laser printers, first, an optical image based on image information is exposed by an exposure unit on the surface of a photoconductive drum charged by a charger to form a latent image, and a developing unit feeds toner to convert the latent image into a toner image. Then, the toner image on the peripheral surface of the photoconductive drum is transferred onto a record sheet by a transfer roller and then, heated and pressed to be fixed on the record sheet.

The image forming device includes a cleaning unit for collecting toner (also called waste toner) and paper dusts, which remain on the surface of the photoconductive drum without being transferred to the record sheet, and temporarily storing and transporting the waste toner toward a waste toner collecting container or the like. The cleaning unit includes a linear transport screw for sending the waste toner to the downstream side in a transport direction (for example, Japanese Unexamined Patent Publication No. 2010-210867).

The cleaning unit has a following problem. That is, since the transport screw is disposed above the photoconductive drum at a distance, to transport the waste toner, much waste toner needs to be stored until it reaches the region where the transport screw is disposed. For this reason, the waste toner is stuck due to stored heat, or paper dusts are accumulated, resulting in that the capability of transporting the waste toner and paper dusts is lowered.

To solve the above-mentioned problem, the transport screw may be made close to the photoconductive drum to reduce the distance. However, a support frame for supporting both ends of the transport screw has various limitations in space for attachment of other parts such as a sealing member, stiffness, and the like and therefore the transport screw cannot be made close to the photoconductive drum in some cases.

On the contrary, under the limitations, by extending the outer diameter of the transport screw, waste toner near the photoconductive drum can be transported. With this configuration, however, space occupied by the transport screw increases, which disadvantageously obstructs miniaturization of the cleaning unit.

BRIEF SUMMARY OF THE INVENTION

Thus, an object of the present invention is to provide a cleaning unit capable of improving the capability of transporting waste toner and paper dusts by decreasing the amount of stored waste toner and paper dusts, and an image forming device having the cleaning unit while achieving miniaturization.

A cleaning unit according to the present invention has the following configuration. The cleaning unit includes a cleaning member, a storage case, and a transport member. The cleaning member collects waste toner on the surface of the photoconductive drum. The storage case successively stores the waste toner collected by the cleaning member through an inlet. The transport member is provided in the storage case, and rotates to transport the waste toner in the storage case in a rotary axis direction. The transport member rotates with a central portion in the rotary axis direction protruding toward the inlet further than both side portions.

With this configuration, since the central portion of the transport member in the rotary axis direction protrudes toward the inlet further than the both side portions, space between the transport member and the photoconductive drum can be decreased, which reducing the amount of stored waste toner and paper dusts and thus improving transportability. Further, since there is no need to increase the outer diameter of the transport member, the cleaning unit can be miniaturized.

The cleaning unit according to the present invention may also be configured as follows. The transport member rotates about the rotary axis in which a central portion in the rotary axis direction protrudes toward the inlet further than both side portions.

The cleaning unit according to the present invention may also be configured as follows. At least a connecting portion between the central portion and the both side portions in the transport member is formed of an elastic body. With this configuration, since at least the connecting portion is formed of the elastic body, the transport member can rotate with the central portion in the rotary axis direction protruding toward the inlet further than the both side portions.

The cleaning unit according to the present invention may also be configured as follows. The transport member is a transport screw entirely formed of an elastic body. With this configuration, the transport member can be integrally shaped, which decreases the number of parts and facilitates manufacturing. Further, since the transport member is entirely formed of the elastic body, even when contacting the photoconductive drum, the transport member is unlikely to damage the photoconductive drum.

The cleaning unit according to the present invention may also be configured as follows. Both side portions of the transport member are located opposed to drum flanges fixed to both respective ends of the photoconductive drum. With this configuration, when both side portions of the transport member are located opposed to the drum flanges, it is difficult to make the entire transport member close to the inlet (photoconductive drum). Thus, as in the present invention, it is advantageous that the central portion of the transport member protrudes toward the inlet to get close to the photoconductive drum.

The cleaning unit according to the present invention may also be configured as follows. The transport member is curved by a spacer on an inner surface of the storage case. With this configuration, the transport member can be easily rotated with the central portion in the rotary axis direction protruding toward the inlet further than the both side portions.

The cleaning unit according to the present invention may also be configured as follows. The transport member is disposed above or lateral to the photoconductive drum. With this configuration, when the transport member is disposed above or lateral to the photoconductive drum, waste toner is easily accumulated in the space between the transport member and the photoconductive drum. Thus, as in the present invention, it is advantageous that the central portion of the transport member protrudes toward the inlet to get close to the photoconductive drum.

An image forming device according to the present invention may also be configured as follows. The image forming device includes the cleaning unit. With this configuration, since the central portion of the transport member in the rotary axis direction protrudes toward the inlet further than both side portions, the space between the transport member and the photoconductive drum can be decreased, which decreases the amount of stored waste toner and paper dusts and thus improves transportability. Further, since there is no need to extend the outer diameter of the transport member, the cleaning unit can be miniaturized. Therefore, it is possible to provide the image forming device having the cleaning unit capable of improving transportability of waste toner and paper dusts by decreasing the amount of stored waste toner and paper dusts while achieving miniaturization.

Other features, elements, processes, steps, characteristics and advantages of the present invention will become more apparent from the following detailed description of embodiments of the present invention with reference to the attached drawings.

DETAILED DESCRIPTION OF EMBODIMENTS OF THE INVENTION

Embodiments of a cleaning unit and an image forming device having the cleaning unit according to the present invention will be described below with reference to drawings. The appended drawings are only schematic and are not necessarily drawn to scale.

[Overall Configuration]

Figure 1:
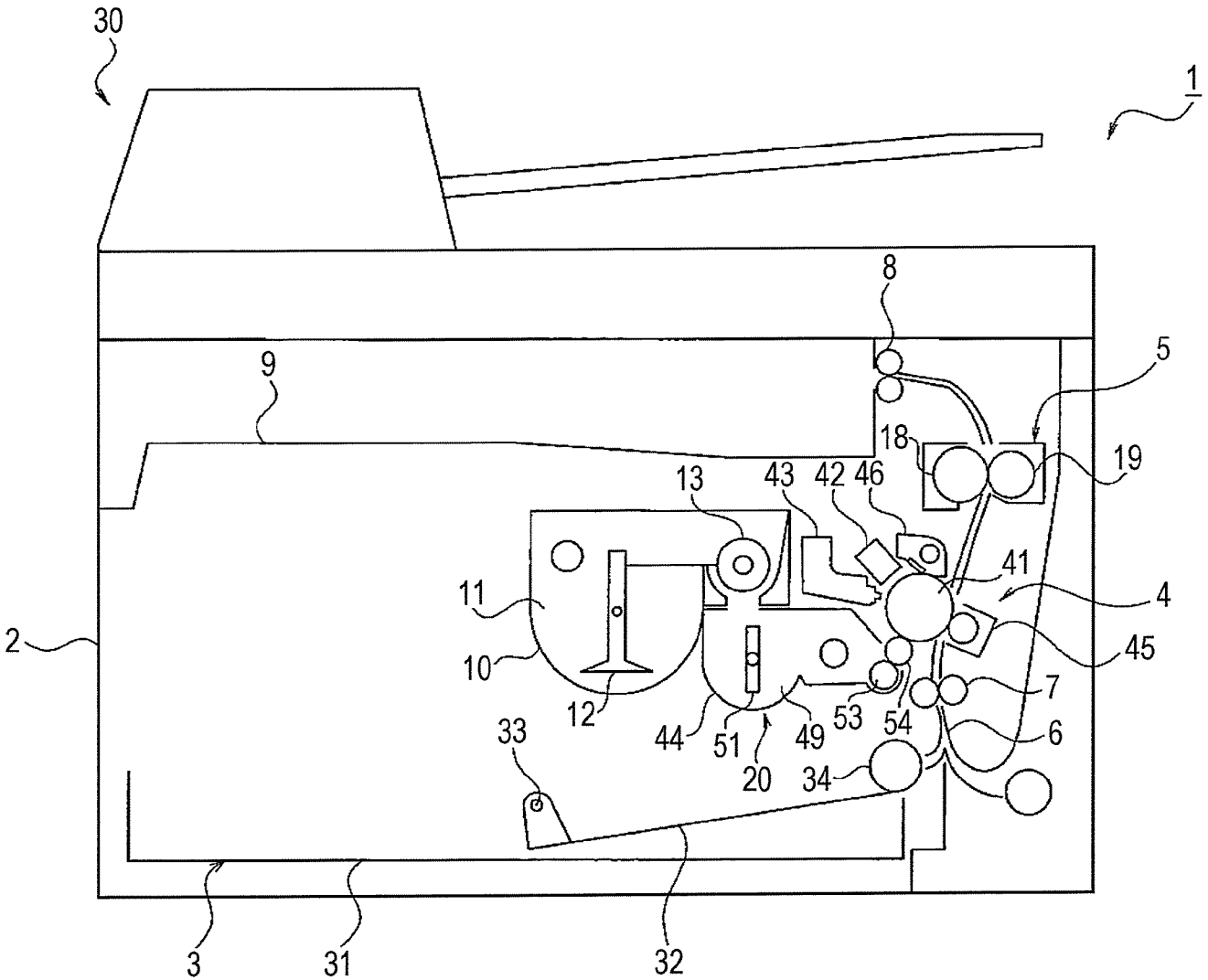
FIG. 1 is a schematic sectional view showing an internal configuration of an image forming device.

FIG. 1 is a schematic sectional view showing an example of an internal configuration of an image forming device 1. The image forming device 1 is a multifunction peripheral that forms an image on a record sheet based on image data of a document read by a document reading unit 30, and an outer shape of the device 1 is defined by a body housing 2. A paper feed unit 3, an image forming unit 4, and a fixing unit 5 are stored in the body housing 2.

The paper feed unit 3 includes a record sheet cassette 31 for storing record sheets, and can store stacked record sheets on a support plate 32 in the record sheet cassette 31. The support plate 32 can rotate a spindle 33 provided at one end, and the other end on the opposite side of the spindle 33 is biased upward, the uppermost record sheet is pressed onto the paper feed roller 34. The paper feed roller 34 rotates in this state, resulting in that record sheets stored in the record sheet cassette 31 are separated from each other by the paper feed roller 34 and a separating pad, and fed one by one to a transport path 6 in the body housing 2.

The record sheet sent from the record sheet cassette 31 to the transport path 6 is transported to the image forming unit 4 through the transport path 6. Then, the record sheet is stopped once just in front of the image forming unit 4 by the resist roller 7, and is sent to the image forming unit 4 according to a timing when the image forming unit 4 forms an image on the record sheet.

The image forming unit 4 has a photoconductive drum 41, and a charger 42, an optical writing unit 43, a developing device 44, a transfer device 45, and a cleaning unit 46 are disposed around the photoconductive drum 41. The image forming unit 4 forms an image on the record sheet according to electrophotography.

A photoreceptor is formed on a surface of the photoconductive drum 41 having a cylindrical shape, and at image formation, the surface of the photoconductive drum 41 to be rotated is uniformly, for example, negatively charged by the charger 42. The optical writing unit 43 causes an LED (Light-Emitting Diode) or a laser light source to selectively output light according to image data of a facsimile document received by a telephone line or image data read by the document reading unit 30. The surface of the photoconductive drum 41, which is uniformly charged by the charger 42, is exposed to the light from the optical writing unit 43 to form an electrostatic latent image.

Toner fed from the developing device 44 is adhered to the surface of the photoconductive drum 41, on which the electrostatic latent image is formed, to form a toner image, and the toner image is transferred onto the record sheet by the transfer device 45. Toner remaining on the front surface of the photoconductive drum 41 after transfer is removed by the cleaning unit 46. The record sheet, on which the toner image is transferred by the transfer device 45, is transported to the fixing unit 5 through the transport path 6.

The developing device 44 employs a nonmagnetic monocomponent developing method, and includes a toner storage chamber 49, an agitator 51 in the toner storage chamber 49, a feed roller 53, and a development roller 54 as a developer carrier. The agitator 51 is rotated, thereby stirring the toner in the toner storage chamber 49. The feed roller 53 is also rotated, thereby triboelectrically charging the toner at a contact portion of the development roller 54 with a regulatory blade to adsorb the toner on the development roller 54.

The fixing unit 5 includes a heating roller 18 heated to a predetermined temperature and a pressure roller 19 that contacts the heating roller 18 at a predetermined pressure. The record sheet, on which the toner image is transferred, passes between the heating roller 18 and the pressure roller 19, and after fixation of toner, is discharged onto a discharge tray 9 provided outside the body housing 2 through a discharge roller 8.

In this embodiment, the toner cartridge 10 that stores toner therein is attached to the developing device 44 such that the toner is fed into the developing device 44. The toner cartridge 10 can be freely attached to/detached from the developing device 44, and includes a toner storage chamber 11, an agitator 12 for stirring toner in the toner storage chamber 11, and a transport screw 13 for transporting the toner in the toner storage chamber 11 to the developing device 44. The transport screw 13 is driven by another transportation system or a TP motor as a motor separated from the image forming unit.

Among the above-mentioned constituents of the image forming unit 4, for example, the photoconductive drum 41, the charger 42, the developing device 44, and the cleaning unit 46 may be integrally combined as a process cartridge 20. The process cartridge 20 can be freely attached to/detached from the main body (housing) of the image forming device 1, and for example, when the developer or the photoconductive drum 41 reaches the end of life, can be detached from the image forming device 1 and replaced with a new one.

[Configuration of Cleaning Unit]

Figure 2:
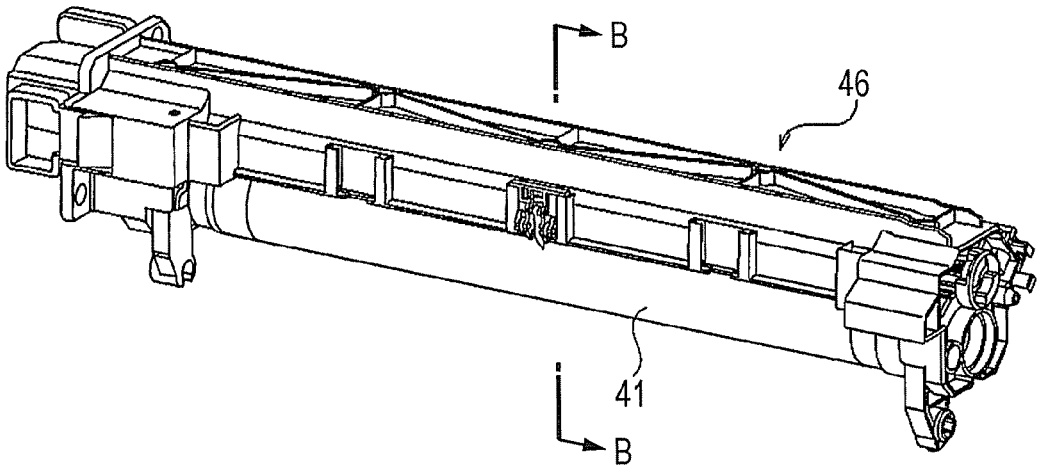
FIG. 2 is a perspective view of a cleaning unit and a photoconductive drum.
Figure 3:
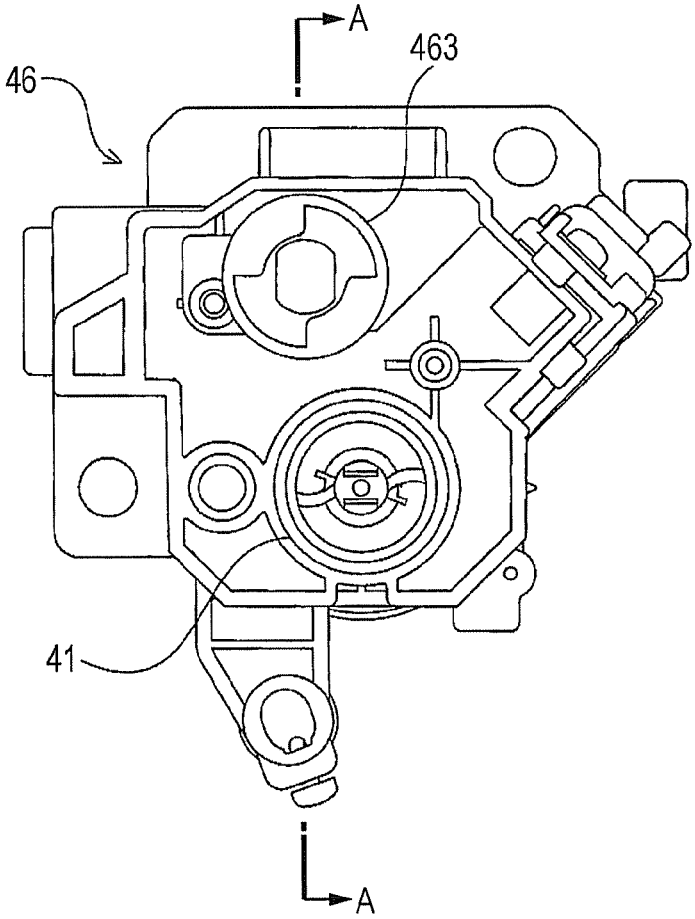
FIG. 3 is a side view of the cleaning unit and the photoconductive drum.
Figure 4:
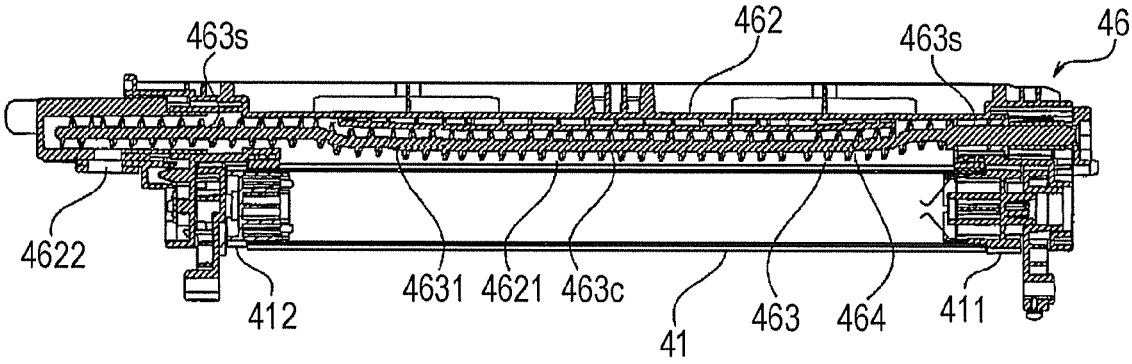
FIG. 4 is a sectional view taken along A-A of the cleaning unit and the photoconductive drum in FIG. 3.
Figure 5:
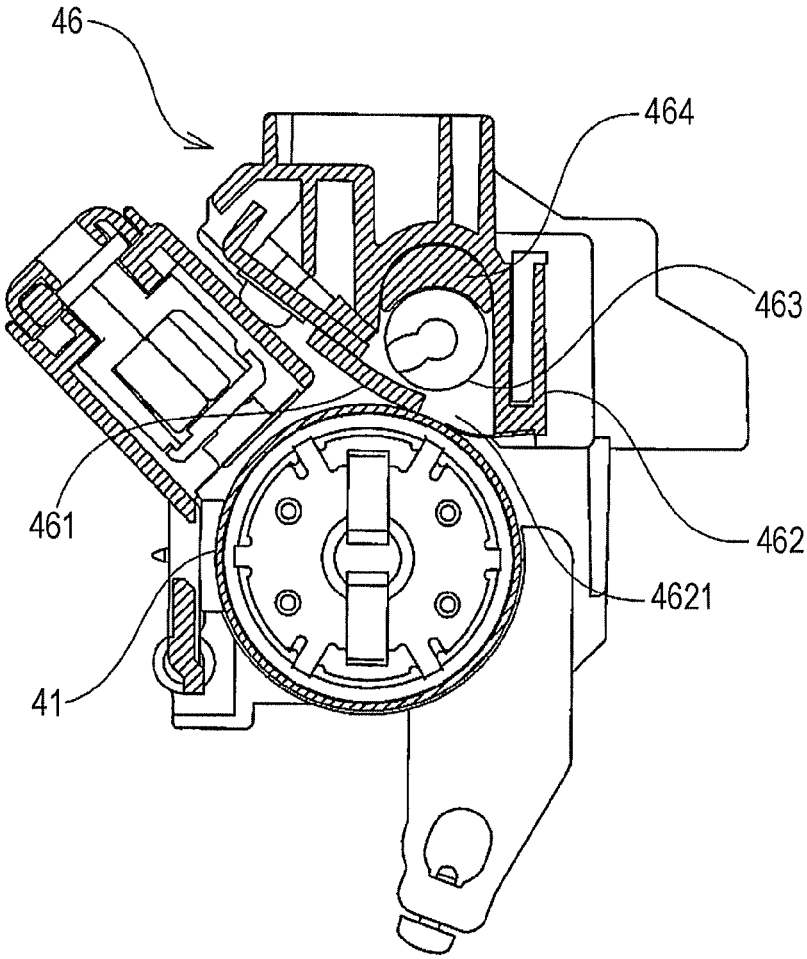
FIG. 5 is a sectional view taken along B-B of the cleaning unit and the photoconductive drum in FIG. 2.

Next, a configuration of the cleaning unit 46 will be described. FIG. 2 is a perspective view of the cleaning unit 46 and the photoconductive drum 41. FIG. 3 is a side view of the cleaning unit 46 and the photoconductive drum 41 in FIG. 2 when viewed from right in the figure. FIG. 4 is a sectional view taken along A-A of the cleaning unit 46 and the photoconductive drum 41 in FIG. 3. FIG. 5 is a sectional view taken along B-B of the cleaning unit 46 and the photoconductive drum 41 in FIG. 2.

The cleaning unit 46 in this embodiment is disposed above the photoconductive drum 41. The cleaning unit 46 may be integrated with the photoconductive drum 41 and configured as a drum unit that can be freely attached to/detached from the main body of the image forming device 1.

The cleaning unit 46 includes a cleaning blade 461 (an example of a cleaning member), a storage case 462, and a transport screw 463 (an example of a transport member).

The cleaning blade 461 collects waste toner on the surface of the photoconductive drum 41. The cleaning blade 461 is a plate-like member made of an elastic material such as rubber, in a state that a front end of the cleaning blade 461 is in contact with the surface of the photoconductive drum 41, a bottom of the cleaning blade 461 is fixed to the storage case 462. The photoconductive drum 41 rotates in this state, resulting in that the waste toner adhered to the surface of the photoconductive drum 41 is scraped off and collected by the cleaning blade 461.

The storage case 462 is hollow inside thereof, and stores the waste toner collected by the cleaning blade 461. A lower surface of the storage case 462 has a slit-like inlet 4621 along the axis of the photoconductive drum 41. The storage case 462 successively stores the waste toner through the inlet 4621.

The transport screw 463 is provided in the storage case 462, and rotates to transport the waste toner in the storage case 462 in the rotary axis direction. The direction in which the waste toner is transported is from the right to the left in FIG. 4. A downstream portion of the transport screw 463 in the waste toner transport direction is opposed to a waste toner discharge port 4622 formed on the storage case 462. A waste toner box is fixed to the downstream portion of the storage case 462 in the waste toner transport direction, and the waste toner passes the waste toner discharge port 4622, and falls into and stored in the waste toner box.

In the transport screw 463, a wing member protruding outward in the radial direction is provided in a helical fashion around a driving axis 4631 (corresponding to the rotary axis) about which the transport screw 463 is rotated. The wing member is provided almost over the driving axis 4631 in the axial direction. When the driving axis 4631 is rotated, the waste toner is transported by the wing member. Both ends of the driving axis 4631 are rotatably supported by both side surfaces of the storage case 462. A motor is provided upstream of the driving axis 4631 in the waste toner transport direction and the driving axis 4631 is rotated by the motor. A motor for rotating the photoconductive drum 41 may be used as a driving source for the transport screw 463.

Both side portions 463*s* of the transport screw 463 face drum flanges 411, 412 fixed to both respective ends of the photoconductive drum 41. The drum flanges 411, 412 are engaged with both ends of the cylindrical photoconductive drum 41. A gear is formed on the outer periphery of the drum flange 411, and the gear is engaged with a gear for driving the photoconductive drum not shown.

The transport screw 463 is disposed above the photoconductive drum 41 at a distance. The waste toner collected from the surface of the photoconductive drum 41 is successively stored in the storage case 462 through the inlet 4621. However, to transport the waste toner, much waste toner needs to be stored until it reaches the region where the transport screw 463 is disposed. For this reason, the waste toner is stuck due to stored heat, or paper dusts are accumulated, resulting in that the capability of transporting the waste toner and paper dusts is disadvantageously lowered.

To solve the problem, the transport screw 463 may be made close to the photoconductive drum 41 to reduce a distance therebetween. However, since the both side portions 463*s* of the transport screw 463 face the drum flanges 411, 412, it is difficult to make the entire transport screw 463 close to the inlet 4621, that is, to the photoconductive drum 41.

As shown in FIG. 4, the transport screw 463 of the present invention rotates with a central portion 463*c* in the rotary axis direction protruding toward the inlet 4621 further than the both side portions 463*s*. That is, the transport screw 463 rotates about the rotary axis in which a central portion in the rotary axis direction protrudes toward the inlet 4621 further than both side portions. The transport screw 463 in this embodiment is entirely formed of an elastic body. Examples of the elastic body include thermoplastic styrene elastomer, urethane elastomer, and the like. Since the transport screw is entirely formed of an elastic body, the transport screw 463 can rotate with the central portion 463*c* in the rotary axis direction protruding toward the inlet 4621 further than the both side portions 463*s*.

A spacer 464 is provided on an internal upper surface of the storage case 462. The spacer 464 is made of ABS resin or the like. As shown in FIG. 5, the cross section of a lower surface of the spacer 464 is shaped like an arc conforming to an upper surface of the transport screw 463. The spacer 464 in the central portion in the waste toner transport direction is higher than that in the both side portions. The length of the spacer 464 in the waste toner transport direction corresponds to that of the central portion 463*c* of the transport screw 463. The length of the spacer 464 in the waste toner transport direction is shorter than that of the photoconductive drum 41. By providing such spacer 464, the transport screw 463 can rotate while maintaining the state where the central portion 463*c* protrudes toward the inlet 4621 further than the both side portions 463*s*.

Figure 6:
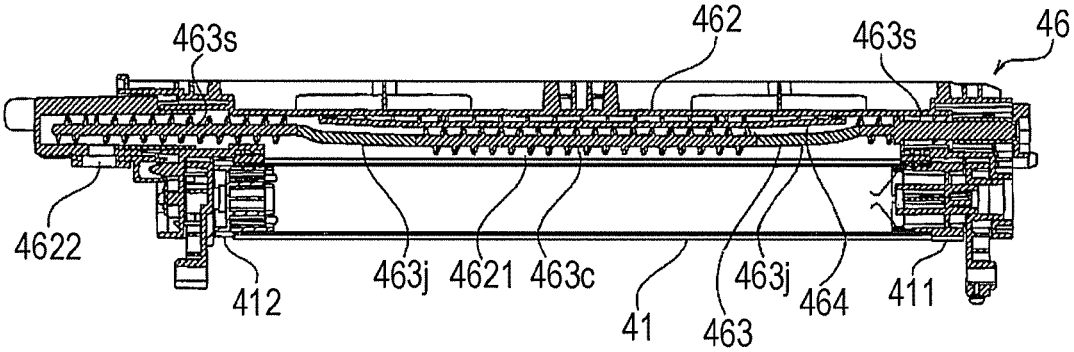
FIG. 6 is a sectional view of a cleaning unit according to another embodiment.

Other Embodiments (1) In the above-mentioned embodiment, the transport screw 463 is entirely formed of the elastic body, but in the transport screw 463, at least a connecting portion between the central portion 463*c* and the both side portions 463*s* in the rotary axis direction may be formed of an elastic body. Specifically, as shown in FIG. 6, since the connecting portion 463*j* between the linear central portion 463*c* and both linear side portions 463*s* is formed of the elastic body, the transport screw 463 can rotate with the central portion 463*c* protruding toward the inlet 4621 further than the both side portions 463*s*. Such connecting portion 463*j* is also referred to as a flexible joint. Preferably, the wing member protruding outward in the radial direction is provided on the connecting portion 463*j*.

(2) In the above-mentioned embodiment, the transport screw 463 is disposed above the photoconductive drum 41, but may be disposed lateral to the photoconductive drum 41.

(3) In the above-mentioned embodiment, the transport screw 463 is used as the transport member, but the transport member is not limited to the transport screw 463. Examples of the transport member include a coil spring.

(4) In the above-mentioned embodiment, the spacer 464 is a member separated from the storage case 462, may be formed integrally with the storage case 462.

While the present invention has been described with respect to embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A cleaning unit comprising:

a cleaning member for collecting waste toner on a surface of a photoconductive drum;

a storage case for successively storing the waste toner collected by the cleaning member through an inlet; and a transport member provided in the storage case, the transport member rotating to transport the waste toner in the storage case in a rotary axis direction, and rotating with a central portion of the transport member in the rotary axis direction protruding toward the inlet further than both side portions of the transport member, wherein a center line of the central portion of the transport member in the rotary axis direction protrudes toward the inlet further than center lines of both of the side portions of the transport member in the rotary axis direction.

2. The cleaning unit according to claim 1, wherein at least a connecting portion between the central portion and both of the side portions in the transport member is formed of an elastic body.

3. The cleaning unit according to claim 1, wherein the transport member is a transport screw entirely formed of an elastic body.

4. The cleaning unit according to claim 1, wherein both of the side portions of the transport member are located opposed to drum flanges fixed to both respective ends of the photoconductive drum.

5. The cleaning unit according to claim 1, wherein the transport member is curved by a spacer provided on an inner surface of the storage case.

6. The cleaning unit according to claim 1, wherein the transport member is disposed above or lateral to the photoconductive drum.

7. An image forming device comprising the cleaning unit according to claim 1.

* * * * *